US005667023A

United States Patent [19]

Harrell et al.

[11] Patent Number: 5,667,023

[45] Date of Patent: Sep. 16, 1997

[54] METHOD AND APPARATUS FOR DRILLING AND COMPLETING WELLS

[75] Inventors: John W. Harrell; Michael H. Johnson; Daniel J. Turick; Larry A. Watkins, all of Houston, Tex.

[73] Assignee: Baker Hughes Incorporated, Houston, Tex.

[21] Appl. No.: 666,150

[22] Filed: Jun. 19, 1996

Related U.S. Application Data

[63] Continuation of Ser. No. 528,574, Sep. 15, 1995, which is a continuation-in-part of Ser. No. 343,814, Nov. 22, 1994, abandoned.

[51] Int. Cl.[6] ..... E21B 7/04; E21B 43/04

[52] U.S. Cl. ..... 175/45; 175/61; 175/41; 175/107; 166/278; 166/358; 166/296; 166/366

[58] Field of Search ..... 175/61, 45, 74, 175/75, 107; 166/278, 296, 358, 366

[56] References Cited

U.S. PATENT DOCUMENTS

| | | | |
|---|---|---|---|
| 1,279,783 | 9/1918 | Stirling . | |
| 1,974,664 | 1/1934 | Patten | 255/61 |
| 2,229,493 | 1/1941 | Croft et al. | 255/1 |
| 2,726,847 | 12/1955 | McCune et al. | 255/1.6 |
| 2,778,603 | 1/1957 | McCune et al. | 255/1.6 |
| 3,463,228 | 8/1969 | Hearn | 166/81 |
| 3,880,233 | 4/1975 | Muecke et al. | 166/205 |
| 4,202,411 | 5/1980 | Sharp et al. | 166/244 C |
| 4,239,084 | 12/1980 | Sharp et al. | 166/278 |
| 4,270,619 | 6/1981 | Base | 175/61 |
| 4,335,788 | 6/1982 | Murphey et al. | 166/278 |
| 4,445,578 | 5/1984 | Millheim | 175/45 |
| 4,544,041 | 10/1985 | Rinaldi | 175/57 |
| 4,651,837 | 3/1987 | Mayfield | 175/262 |
| 4,828,053 | 5/1989 | Maurer et al. | 175/75 |
| 4,962,818 | 10/1990 | DeLucia | 175/75 |
| 5,148,875 | 9/1992 | Karlsson et al. | 175/62 |
| 5,160,925 | 11/1992 | Dailey et al. | 340/853.3 |
| 5,163,521 | 11/1992 | Pustanyk et al. | 175/40 |
| 5,197,553 | 3/1993 | Leturno | 175/57 |
| 5,234,055 | 8/1993 | Cornette | 166/278 |
| 5,253,708 | 10/1993 | Alexander | 166/278 |
| 5,255,741 | 10/1993 | Alexander | 166/278 |
| 5,311,952 | 5/1994 | Eddison et al. | 175/61 |
| 5,368,109 | 11/1994 | Pittard, Jr. et al. | 175/45 |
| 5,373,481 | 12/1994 | Orban et al. | 367/32 |

OTHER PUBLICATIONS

Smith, R.C., et al., *The Lateral Tie–Back System: The Ability to Drill and Case Multiple Laterals;* pp. 55–64; Feb. 15, 1994; IADC/SPE Drilling Conference, Dallas, Texas.

*Primary Examiner*—Dennis L. Taylor
*Attorney, Agent, or Firm*—Gerald W. Spinks

[57] ABSTRACT

A method and apparatus for drilling and completing a bore hole are disclosed. The method comprises positioning a work string in the well, with a bottom hole assembly attached. The bottom hole assembly can include a drill bit, a drilling motor, orientation instrumentation, and a completion assembly. A fluid is circulated to drive the drill bit to drill the well to a target formation. Then, the completion assembly is used to produce fluids from the formation. Gravel packing can also be performed with the bottom hole assembly.

25 Claims, 12 Drawing Sheets

METHOD AND APPARATUS FOR DRILLING AND COMPLETING WELLS

RELATED APPLICATIONS

This is a continuation patent application of U.S. patent application Ser. No. 08/528,574, filed on Sep. 15, 1995, and entitled "Method of Drilling and Completing Wells", which is a continuation-in-part of U.S. patent application Ser. No. 08/343,814, filed on Nov. 22, 1994, and entitled "Method of Drilling and Completing Wells", now abandoned.

FIELD OF INVENTION

The present invention relates to drilling and completing of wells. In particular, but not by way of limitation, the invention relates to drilling and completing of hydrocarbon wells.

BACKGROUND OF THE INVENTION

In order to recover hydrocarbons, a well is drilled into the ground until a hydrocarbon reservoir is encountered. In the earlier days of oil and gas exploration, most well sites were located on shore, and the wells that were drilled were primarily vertical. As the search for larger hydrocarbon reservoirs continues, the exploration is now focusing on offshore locations and remote land sites. Further, many wells are being drilled and completed as highly deviated and horizontal wells for economical and logistical reasons.

In offshore waters, one type of installation includes use of a fixed platform wherein the legs of the platform are rigid and embedded into the sea floor. The fixed platform has been a very popular type of structure; however, as the search for reserves continues, oil and gas companies find themselves searching in offshore locations were the water depths may be as deep as 6,000'.

As regards land locations, the exploration, drilling and production are now taking place in remote locations that may include arctic regions, desert regions, or even the rain forest of Latin America. Regardless of the inland or offshore location of these rigs, the remote nature of their location and the necessary ancillary equipment and personnel that must follow translate into very significant rental rates for rigs.

In offshore waters, traditional fixed platforms are not generally placed in depths generally greater than 1000'. Therefore, tension leg platforms, drilling ships or semi-submersible drilling vessels are being used to drill these deep water wells. Typically, this involves the drilling rig being placed on the ship or floater. A sub sea Blow Out Preventor stack (BOP) is then placed on the ocean floor. A riser is then connected from the sub-sea BOP to the drill floor. The bore hole can then be drilled.

Once the well has been drilled and a hydrocarbon reservoir has been encountered, the well is ready to be completed. Many sub-sea wells are completed as single satellite wells producing to a nearby platform. They are a means of producing field extremities that cannot be reached by directional drilling from an existing platform and where the economics do not justify the installation of one or more additional platforms. Some multi-well templates and piping manifolds have been installed that go beyond the satellite well concept.

Also, new methods of well bore construction, such as found in application Ser. No. 08/411377, filed on 27 Mar. 1995 by Applicant and incorporated herein by reference allow for the drilling of a primary access well bore. The primary access well bore will have one or more branch well bores extending therefrom that will intersect certain target reservoirs. The invention herein described may be utilized with the drilling and completion of these branch well bores. Of course, the invention herein disclosed is also applicable to other types of field development.

Governments have recognized the importance and the necessity of drilling and completing wells. Nevertheless, significant regulations exist for each phase of the drilling, completing, and producing operation. Thus, when a certain size drill string is substituted for a second size, or alternatively, when a production tubing is substituted for drill pipe, operators will require the changing of the BOP ram members so that control of the well bore is always maintained. This is a crucial concern because control of the well bore is essential at all times.

When the operator is converting from the drilling phase to the completion phase, the BOP stack must be changed out to accommodate the different outer diameter sized work string—from drill pipe to a production string. Furthermore, during the actual completion phase, the production tubing must be manipulated in order to perform the necessary functions such as perforating, circulating, gravel packing and testing. According to established safety procedures mandated by operator rules and government regulations, it is necessary to change out the BOP rams during certain phases. The changing out of BOP rams can be a costly and time consuming practice. Day rates for drill ships and semi-submersible ships can be quite expensive, and during the procedure for changing out the rams, no other substantive operations can be accomplished.

In a typical offshore location, wherein the drilling rig is either a jack-up vessel or placed upon a fixed platform, the BOP is normally situated on the vessel or platform itself. Nevertheless, because of safety considerations and government regulations, the control of the well bore from blow-out is always of primary concern. Therefore, safety of the installation along with economically performing the operation has always been an essential requirement.

There is a need to drill to a target reservoir, and thereafter, leave the work string in the well bore, thereby having the well bore drilled and completed in one step. There is also a need to complete a well in a cost effective manner that will also comply with government regulations. In order to minimize cost, several techniques have been employed with varying degrees of success. One technique has been to drill and case the well, and then immobilize the drilling rig. A replacement rig is then utilized to complete the well. The replacement rig may vary from a snubbing unit, coiled tubing unit, workover rig using smaller inner diameter pipe, or in some cases wire line. Thus, rather than completing the well with the more expensive rig, a less expensive rig is utilized which saves cost but not time. Therefore, there is a need to provide for a more cost effective means for drilling and completing wells in the exotic locations of the world in a timely fashion.

SUMMARY OF THE INVENTION

An apparatus for drilling, completing and thereafter producing a reservoir is described. The apparatus may contain a work string and a completion assembly attached to the work string. The apparatus further contains a drilling motor assembly adapted to the work string for creating a bore hole; and, an orientation sensor adapted to the drilling motor assembly for sensing the physical location of the bit. In the preferred embodiment, the orientation sensor is placed near the bit.

The apparatus may further comprise a formation evaluation sensor adapted to the work string for sensing the physical parameters of a subterranean reservoir and a telemetry device adapted to receive and output signals from both the orientation sensor and the formation evaluation sensor. A communication device may also be included for communicating an output signal from the orientation sensor and communicating the output signal to the telemetry device. The telemetry device then transmits the output signals to the surface.

In this embodiment, the drilling motor assembly comprises a motor, an adjustable kick-off sub, and a drill bit. This embodiment may also have a production sensor adapted to the completion assembly for sensing the production parameters of the subterranean reservoir.

Utilizing this embodiment, the method would include lowering the bottom hole assembly and circulating the drilling fluid through the bottom hole assembly so that the drilling motor assembly effects rotation of the bit. While drilling is proceeding, the orientation sensor will sense the physical location of the bit. The output signal is communicated to the telemetry device which ultimately transmits the orientation output signals to the surface. After analyzing the output signals, the operator may steer the bottom hole assembly for optimum placement of the completion assembly across the target zone.

The method may further include pumping an acid in order to dissolve an acid soluble compound that may be contained on the completion assembly. Thereafter, the well may be placed on production. Permanent production sensors may be placed on the completion assembly and production parameters may be monitored during the life of the well.

In another embodiment, an apparatus for drilling and completing a well will comprise a work string attached to a completion assembly. A drilling motor is adapted to the work string for creating a bore hole, with the drilling motor being positioned upstream of the completion assembly. Also included is a bit operatively associated with the drilling motor assembly; an inner drive shaft connecting the motor with a bearing housing; and an orientation sensor adapted to the bit for sensing the physical location of said bit.

This apparatus may also include a communication device adapted to the orientation sensor for communicating an output signal from the orientation sensor to a telemetry device, with the telemetry device being operatively associated with the work string. Also included may be a formation evaluation sensor adapted to the work string for sensing the physical parameters of a subterranean reservoir, with the formation evaluation sensor being operatively associated with the telemetry device.

A production sensor may be adapted to the completion assembly for sensing the production characteristics of the subterranean reservoir. The drilling motor and inner drive shaft are selectively retrievable from the bottom hole assembly. Thus, after the drilling and completing of the well, the drilling motor and drive shaft may be retrieved from the well.

The method for this embodiment would include lowering the bottom hole assembly into a well bore and circulating the drilling fluid so that the drilling motor assembly drills a bore hole. The orientation sensor would sense the physical location of the bit. The output signal is ultimately transmitted uphole and the bit is steered so that the completion assembly is placed across the target reservoir.

This would also include withdrawing from the well the drill string, the drilling motor and the drive shaft. Thereafter, the production string is run into the well, and after proper landing, the well may be placed on production. If the completion assembly contains an acid soluble compound, an acid may be pumped down in order to remove it for production. As mentioned earlier, a production sensor may be included so that production parameters may be monitored during the life of the well.

In another embodiment, the apparatus includes a work string, a completion assembly attached to the work string, and a drilling motor concentrically positioned within the inner diameter of the completion assembly. Also, the apparatus would include: a bit operatively associated with the drilling motor assembly; a sealing member concentrically positioned within the completion assembly and connected to the motor; and, an orientation sensor adapted to the bit for sensing the physical location of the bit.

The apparatus may further include a communication device adapted to the orientation sensor for communicating an output signal from the orientation sensor to a telemetry device, with the telemetry device being operatively associated with the work string. The apparatus further comprises a formation evaluation sensor adapted to the work string for sensing the physical parameters of a subterranean reservoir, with the formation evaluation sensor being operatively associated with the telemetry device. This embodiment also includes a production sensor adapted to the completion assembly for sensing the production characteristics of the subterranean reservoir. In this embodiment, the drilling motor and inner drive shaft is selectively retrievable by a secondary string.

The method utilizing this embodiment includes lowering the bottom hole assembly into a well bore and circulating a fluid through the drilling motor assembly so that a bore hole is formed. Next, the physical location of the bit is determined as previously described.

The method further comprises steering the bottom hole assembly so that a target reservoir is encountered. Thereafter, a secondary string containing a retrieving tool is lowered into the well bore and the drilling motor assembly can be retrieved. The method further includes positioning a production string into the well, and thereafter, the reservoir may be produced through the completion assembly. As in the other embodiments, a production sensor may be placed on the completion assembly so that production parameters may be monitored during the life of the well. If a hydrophone sensor is placed on the production string, the method may further include monitoring a response to an acoustic event. The acoustic event may be generated from a hydrophone transmitter in the production string, or from another acoustic source elsewhere in the well bore, another well bore within the reservoir, or even from the surface.

An advantage of the present invention includes the saving of rig time by having a well drilled and completed in one step. Another advantage includes steering the bottom hole assembly for optimum placement within a target reservoir. Another advantage includes increasing the productivity of the reservoir. Another advantage is that since the well is completed faster, there is less exposure to drilling fluid which damages the reservoir.

Still yet another advantage includes using the invention with multilateral and directional well bores. Another advantage includes use of this system from a main access well bore in order to drill and complete a branch well.

A feature of the present invention includes use of an orientation sensor that is placed near the bit. Another feature is use of a communication device that communicates the output of the orientation sensor to a telemetry apparatus for ultimate transmission to the surface. Another feature is the completion assembly is placed upstream of the orientation sensor so that the completion assembly is optimally placed within the target reservoir.

Still yet another feature includes the use of permanent sensors on the completion assembly that will monitor the target reservoir and its production of fluid and gas. These sensors may communicate with a host module located, for instance, in a main access well bore. Another feature includes use of a motor that may be placed upstream of the completion assembly. Another feature includes use of a motor that has extending therefrom a drive shaft concentrically placed within the completion assembly for connection to a thrust bearing near the bit. This allows for the motor to be above the completion assembly and thus retrievable. Also, the completion assembly is closer to the bit, and thus, the driller does not have to drill as much additional hole to properly position the completion assembly within the reservoir.

Another feature includes use of a slim hole motor that is concentrically placed within the completion assembly that is also selectively retrievable. Still yet another feature includes the ability to gravel pack after drilling and positioning of the completion assembly. Still yet another feature includes placement of a soluble compound about the completion assembly.

This device may also contain a completion assembly for completing the well, which in one embodiment would be a preventing arrangement for preventing the production of a reservoir sand into the inner diameter of the work string, also referred to as a screen. The steps would then include positioning the screen adjacent the target reservoir; and, placing a gravel slurry in the annulus adjacent to the target reservoir. The preventing arrangement may include a soluble compound, and which would require after having the preventing arrangement in position, displacing an acid solution for dissolving the soluble compound; and thereafter, placing the well on production.

Another advantage includes the ability to complete subsea wells without changing out the rams of the Blow Out Preventor stack since the work string may remain in place after drilling through the target reservoir. Still yet another advantage includes having a drilling bottom hole assembly attached to a production string such that the production string is drilled into the target reservoir, and the well can be placed on production without the necessity of pulling out of the hole and replacing the work string.

The novel features of this invention, as well as the invention itself, will be best understood from the attached drawings, taken along with the following description, in which similar reference characters refer to similar parts, and in which:

DESCRIPTION OF PREFERRED EMBODIMENTS

Figure 1:
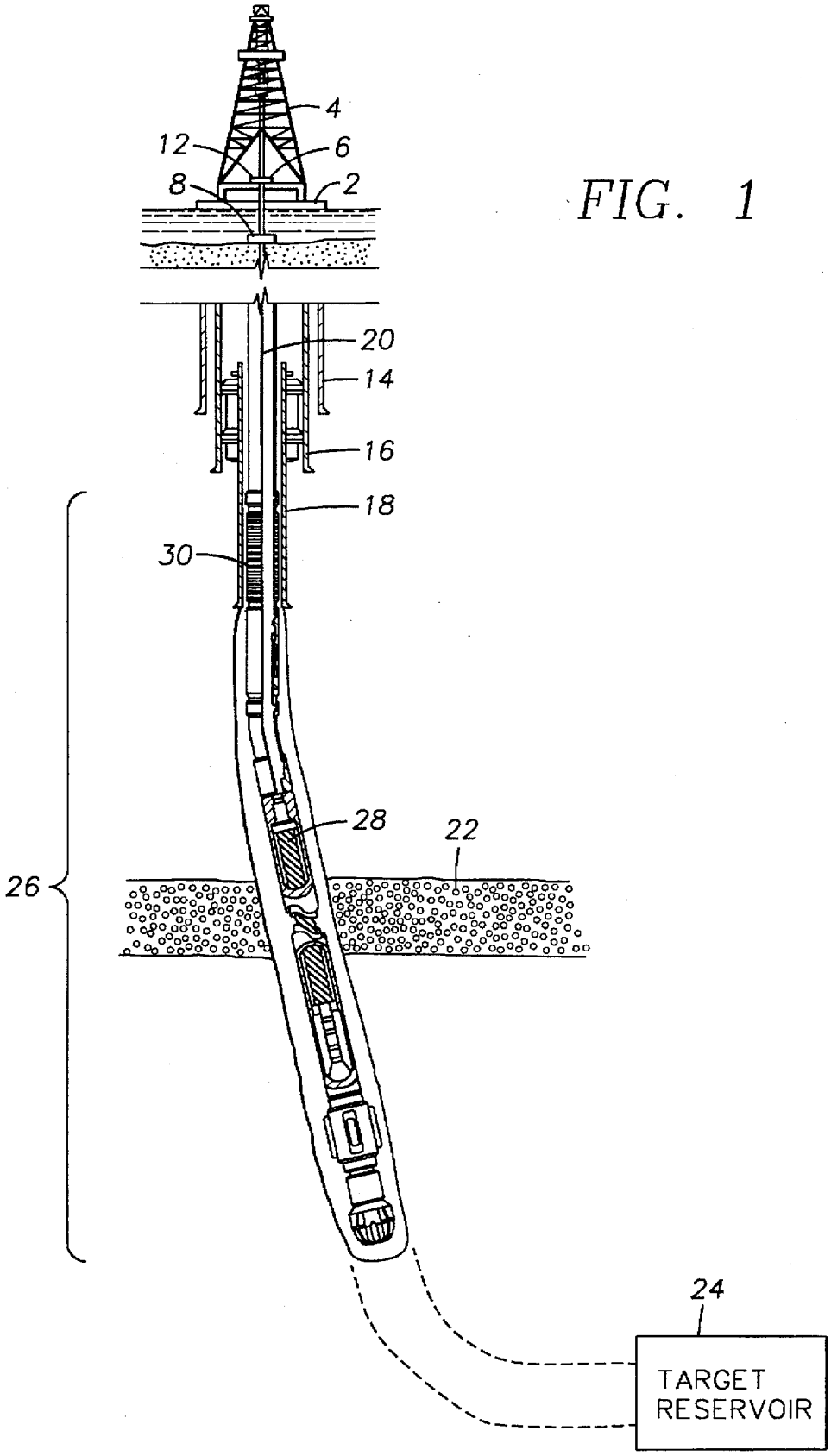
FIG. 1 is a partial section view of one embodiment of the present invention.

FIG. 1 depicts a semi-submersible drilling vessel 2 that has mounted thereon a drilling rig 4. The drilling rig 4 is typically equipped with a surface Blow-Out Preventor (BOP) stack 6 as is well known in the art. A sub-sea Blow-Out Preventor stack 8 is positioned on the ocean floor 10, with a riser 12 linking the sub-sea BOP stack 8 to the surface BOP stack 6. Extending into the earth from the sub-sea BOP stack 8 are the well casings, specifically the conductor casing 14, the surface casing 16, and the intermediate casing 18.

As is well understood by those of ordinary skill in the art, the well bore will often intersect various subterranean reservoirs 22, 24, some of which may contain hydrocarbons. As is shown in FIG. 1, an intermediate reservoir 22 has been passed through, and a target reservoir 24 has yet to be drilled through. A work string 20 according to the present invention is suspended within the riser 12 and the casings 14, 16, 18. The work string 20 has attached thereto a bottom hole assembly 26. The particular work string 20 shown in FIG. 1 is a drill string, and the bottom hole assembly 26 includes a drill motor assembly 28, as well as a completion assembly 30.

Figure 2:
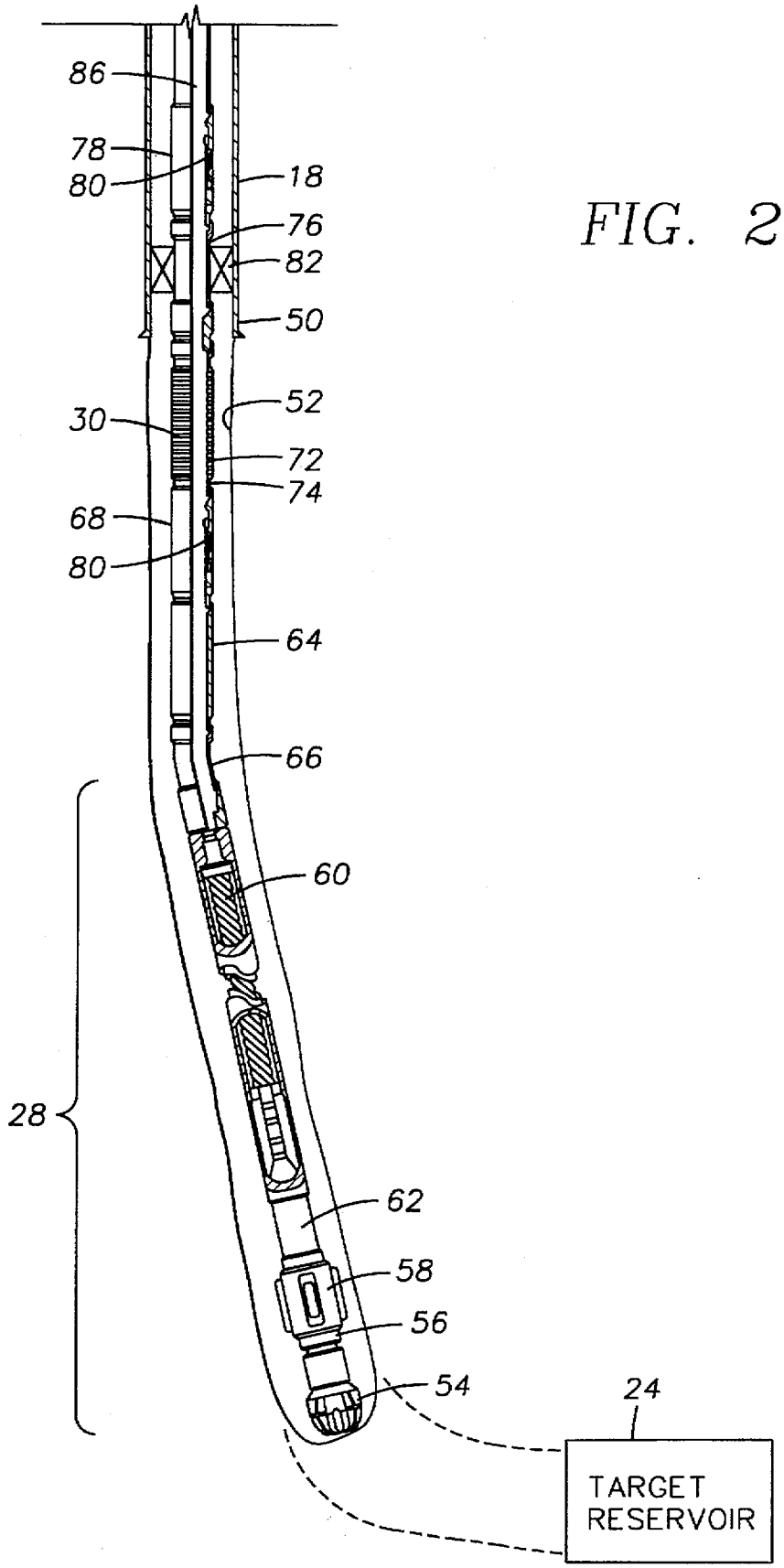
FIG. 2 is a section view of a fast embodiment of a bottom hole assembly for use in the present invention.

Referring now to FIG. 2, a cased hole 50 has extending therefrom an uncased bore hole 52. The bore hole 52 has been drilled by the drill motor assembly 28, which in this embodiment includes the bit 54, a bearing assembly 56, a centralizing sub 58, and the rotor/stator assembly 60. An applicable rotor/stator assembly 60 that may be used is available from the applicant, Baker Hughes Incorporated (BHI), under the product name Navi-Drill™. The centralizing sub 58 may contain static blades or hydraulically or mechanically extendable blades which would aid in the steering of the bottom hole assembly 26.

A lower sensor module 62 is included in the bottom hole assembly 26. The lower sensor module 62 can contain directional sensors such as a magnetometer, an accelerometer, an inclination instrument, and a tool face instrument, all being well known in the art and available from BHI under the product name Navi-TRAK™. The lower sensor module 62 may also contain formation evaluation sensors such as resistivity and gamma ray instruments, both being well known in the art and available from BHI under the product name Navi-MPR™ (Multiple Propagation Resistivity). The operator may also choose to place an axial strain sensor or a torsional strain sensor on the work string 20, to measure the weight and torque that are being applied to the bit 54.

The sensors contained within the lower sensor module 62 generate output signals. These output signals may be transmitted to a host module 64 that will receive the output signals, convert the signals to an appropriate data signal, and ultimately transmit the data signal to the surface. One such system was described in U.S. Pat. No. 5,160,925 assigned to BHI and incorporated herein by reference thereto. This system utilizes an electromagnetic short-hop system that transmits from the sensor module to the Measurement While Drilling (MWD) host module. The telemetry system can be mudpulse, acoustic, electromagnetic, or other systems.

As is well known in the art, the MWD host module 64 can contain certain other sensors such as a gamma ray instrument, a resistivity instrument, and a density instrument, all of which are available from BHI under the product name Navi-TRAK™. The MWD host module 64 may also contain directional sensors such as the previously described magnetometer, accelerometer, and inclination instruments. These types of sensors provide lithology correlation information and directional data while drilling.

The bottom hole assembly 26 may also include an adjustable kick off tool 66 that is upstream of the rotor/stator assembly 60, but downstream of the completion assembly 30. The adjustable kick off tool 66 is commercially available from BHI under the product name AKO™. Also included in the bottom hole assembly 26 is a connector sub 68 that can be used to disconnect the drill motor assembly 28 from the work string 20 in the case of trouble, such as the drill motor assembly 28 becoming stuck. The connector sub 68, commercially available from BHI under the trade name Mechanical & Hydraulic Release Sub, has a collet member 80, for attachment and release purposes.

In the embodiment shown in FIG. 2, the connector sub 68 is threadedly attached to the MWD host module 64 and the completion assembly 30. The completion assembly 30 is a wire screen 72 around a perforated pipe 74, which is often referred to by those of ordinary skill in the art as a gravel pack screen. This type of completion assembly is commercially available from BHI under the product name BAKER-WELD™. It should be understood, however, that other types of screens are available such as the slotted liner, and prepacked screens.

An acid soluble compound is placed in apertures of the completion assembly 30. The soluble compound keeps solids, such as drill cuttings and drilling fluid contaminants, from plugging the completion assembly 30. The soluble compound can be a wax material, although other soluble compounds can be used. The soluble compound must be robust enough to withstand pressure differentials over 1000 psi, to temporarily seal the completion assembly 30 against the pressure drop in the drilling fluid as it drives the rotor/stator assembly 60 and the pressure drop caused by nozzles in the bit 54.

The completion assembly 30 is connected to a spacer pipe 76, which in turn is connected to another connector sub 78, similar to the connector sub 68. The connector sub 78 also has a collet 80. Below the upper connector sub 78, the work string 20 has attached thereto a hang and release packer 82 that enables the lower portion of the work string 20 to be hung on the intermediate casing 18. The hang and release packer 82 is commercially available from BHI under the product name Retrievable Hydraulic Set Packer. The hang and release packer 82 can be installed on the spacer pipe 76.

Figure 3:
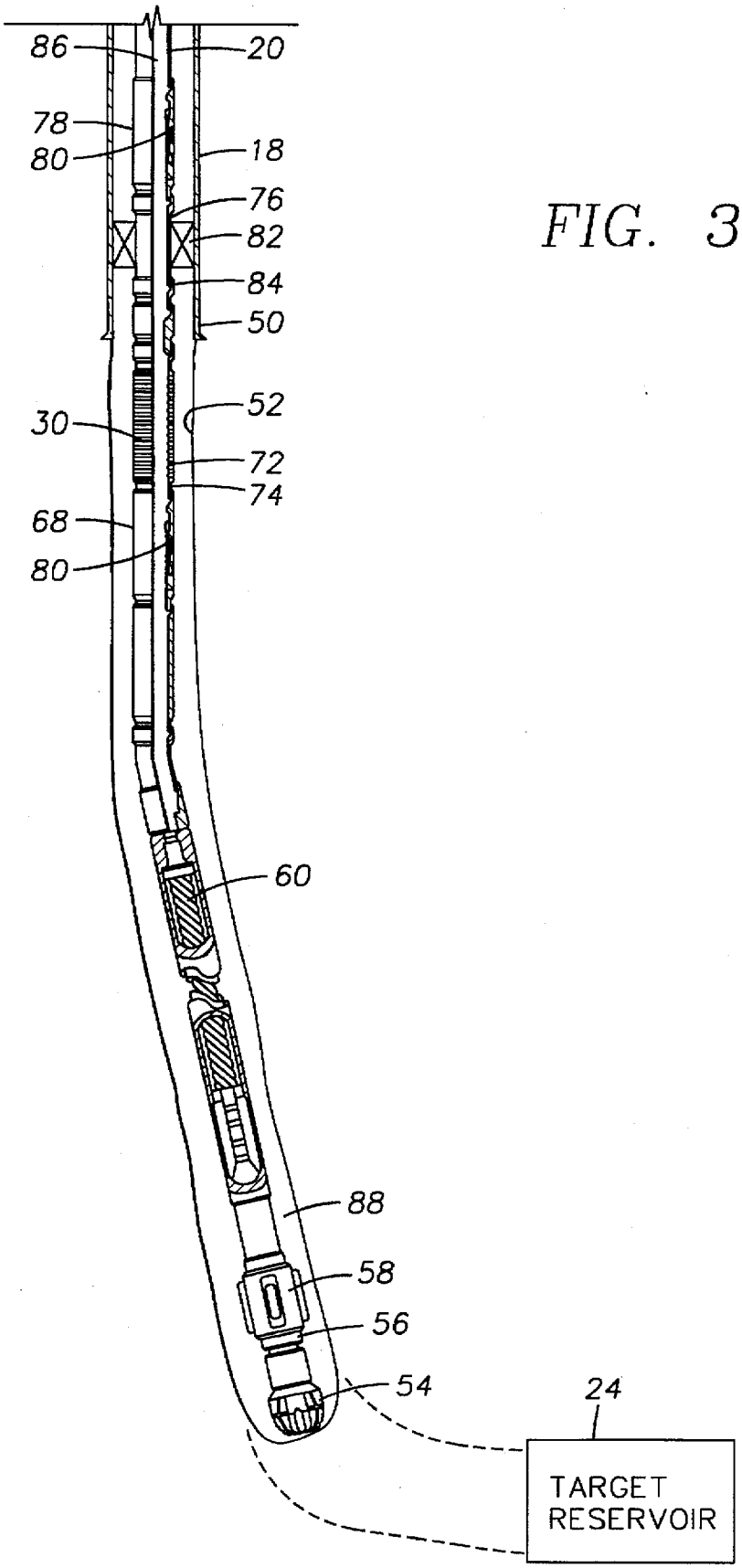
FIG. 3 is a section view of a bottom hole assembly as shown in FIG. 2, further containing a production sensor package.

Referring now to FIG. 3, the bottom hole assembly 26 of FIG. 2 is shown with a production sensor assembly 84 attached thereto. The production sensor assembly 84 is able to monitor the gas-oil ratio, the water-oil ratio, and the gas-water ratio, as well as the pressure and temperature of the reservoir. These are all important factors in evaluating the reservoir performance for ultimate recovery. The production sensor assembly 84 will be capable of monitoring the fluid stream from the reservoir throughout the life of the well. Analysis of dam received from the production sensor assembly 84 will enable the operator to monitor the production profile and reservoir characteristics through time. The operator may also choose to install a series of hydrophone sensors in the production sensor assembly 84, that can detect acoustic signals in the reservoir, originating from a well bore or from the surface. The hydrophone sensors can also sense micro-seismic events in the reservoir, such as small slip plane or fault movement. Thus, the phones could be used as pan of cross well acoustic imaging, near well acoustic imaging, reservoir imaging, and as receivers for imaging via a surface seismic source.

The production sensor assembly 84 may communicate with a host controller (not shown), as is well known in the art. The host controller may be located at some point in the intermediate casing 18. In the case of a branch well extending from a main access well bore, the host controller may be located in the main access bore, and other production sensor assemblies in other branch wells can also communicate with the host controller. The production sensor assembly 84 may communicate with the host controller via a short-hop telemetry system, or the connection may be hard-wired.

Figure 4:
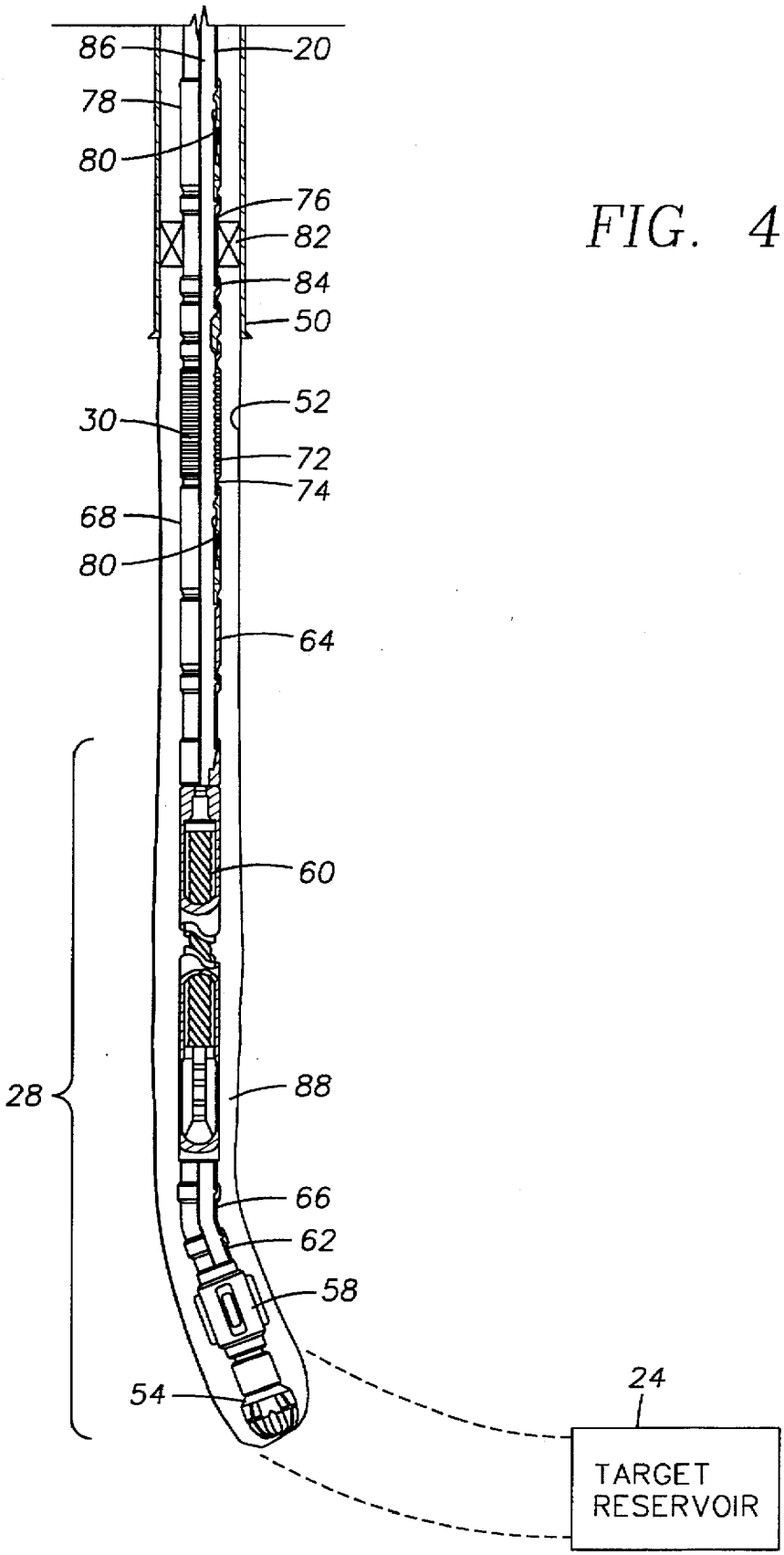
FIG. 4 is a section view of a second embodiment of a bottom hole assembly for use in the present invention.

FIG. 4 shows a second embodiment of the bottom hole assembly 26, similar to the embodiment of FIG. 3, except that the adjustable kick-off sub 66 has been moved to a location below the rotor/stator assembly 60. The same type of lower sensor module 62 and MWD host module 64 are again used. In this embodiment, the primary well path deflection point is moved closer to the bit 54, allowing higher angle build rates and improved directional control, yielding a smoother well path. In order for the rotor/stator assembly 60 to impart rotation to the bit 54, a flexible u-joint may be included in the adjustable kick-off sub 66.

In using the embodiments of FIGS. 1, 2, 3 and 4, the cased hole 50 is drilled and cased, as is well known in the art. The work string 20 and bottom hole assembly 26 of the present invention are used for this purpose, resulting in the bottom hole assembly 26 being positioned within the cased hole 50. The work string 20 may be a drill pipe, coiled tubing, or small diameter pipe.

It should be noted that a larger drilling rig may have been used to drill and case the hole. If so, the bottom hole assembly 26 may be run in and set via the hang and release packer 82. Then, the larger drilling rig may be immobilized and a smaller, less expensive rig may be used to further drill and complete the well, in accordance with the present invention.

In order to drill, the operator first makes sure that the hang and release packer 82 is not set. Then, a drilling fluid is pumped down the inner bore 86 of the work string 20. The drilling fluid flows through the drill motor assembly 28, resulting in rotation of the bit 54. The return path of the drilling fluid is up the annulus 88 to the surface. In the embodiment of FIGS. 2 and 3, only the bit 54 rotates; however, in the embodiment of FIG. 4, both the lower sensor module 62 and the bit 54 may rotate.

The lower sensor module 62 constantly monitors the orientation of the bit 54 by taking accelerometer, magnetometer, inclination and tool face readings and generating output signals representative thereof. As is well understood by those of ordinary skill in the art, the magnetometer/accelerometer measures the earth's magnetic and gravitational fields to derive a directional survey. The output signal of the lower sensor module 62 is then transmitted via the short-hop telemetry transmitter to the MWD host module 64. The host module 64 processes the sensor signals and then transmits data uphole. The host module 64 can contain a mud-pulse valve; however, other types of telemetry devices can be used, such as acoustic, electromagnetic or others.

Once the signals are received at the surface, the signals are analyzed and the position and direction of the well bore are determined. The operator can adjust the trajectory of the path as deemed necessary. The host module 64 also contains sensors which are sampling certain reservoir characteristics, and the outputs of these sensors are transmitted uphole via the telemetry system. This data is also used in order to steer the bottom hole assembly 26 for optimum placement of the completion assembly 30 relative to the target reservoir 24, for instance, across the target reservoir 24.

The steering takes place by intermittently rotating or turning the work string 20, activating ribs on the centralizing sub 58, or adjusting the adjustable kick off sub 66. The soluble compound can then be removed from the completion assembly 30 by pumping an acid down the work string 20. The well may then be placed in production. Alternatively, the operator may desire to gravel pack the well, and thereafter, begin production.

Alternatively, with the hang and release packer 82 installed on the spacer pipe 76, the operator can release the work string 20 from the bottom hole assembly 26 with the connector sub 78 and pull out of the well. Then, a production string may be lowered into the well and stabbed into the bottom hole assembly 26. A gravel pack may be performed, either with the original work string 20, or alternatively, after the production string has been connected.

Figure 5:
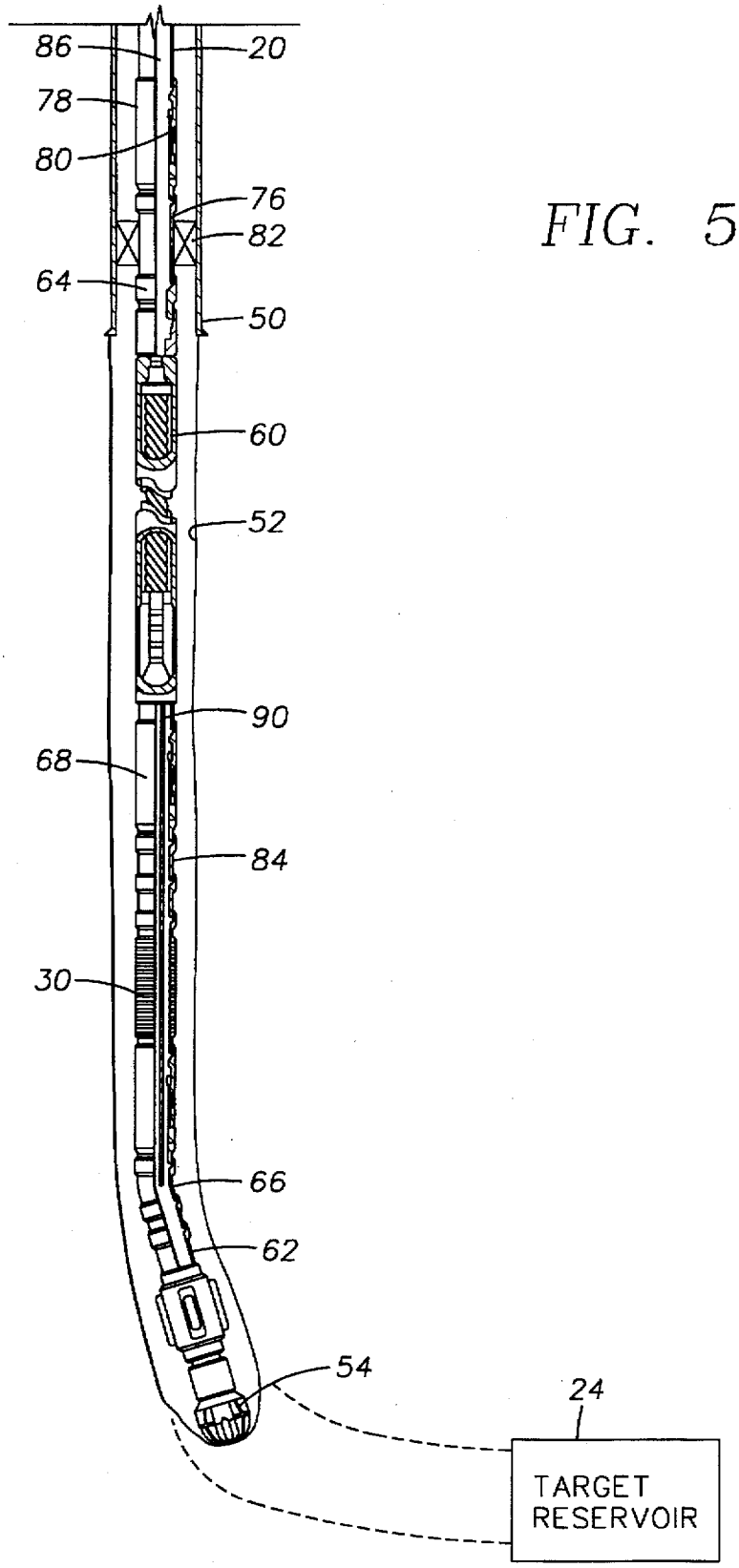
FIG. 5 is a section view of a third embodiment of a bottom hole assembly for use in the present invention.

Referring now to FIG. 5, another embodiment of the present invention is shown. In this embodiment, a retrievable rotor/stator assembly 60 is positioned above the completion assembly 30. In this embodiment as well, the work string 20 has attached to thereto the hang and release packer 82 along with the connector sub 78. The rotor/stator assembly 60 is attached to a motor drive shaft 90 that passes concentrically through the center of the completion assembly 30 to the adjustable kick off sub 66. The drive shaft 90 is removably mated to a flex joint located within the adjustable kick off sub 66, such as by means of a simple longitudinal spline connection. In this embodiment, the completion assembly 30 is closer to the bit. The rotor/stator assembly 60 and the drive shaft 90 are retrievable from the completion assembly 30.

In operation of this embodiment, the operator circulates drilling fluid down the internal bore 86 of the work string 20 and through the rotor/stator assembly 60. Rotation is imparted to the bit 54 via the flex joint and the drive shaft 90, rotating within the completion assembly 30. As drilling proceeds, the lower sgeneratesule 62 generates output signals which are received by the host module for ultimate telemetry to the surface, all as previously described. The output signals from the sensors contained within the host module will also be transmitted to the surface. After analysis, the operator may steer the bottom hole assembly 26 into proper placement relative to the target reservoir 24.

If an acid soluble compound was included on the completion assembly 30, an acid may be pumped down to dissolve it. Gravel packing the well may also take place at this point, or after a production string is in place. Then, the operator can retrieve the work string 20 along with the rotor/stator assembly 60, the flex joint, and the drive shaft 90. Thereafter, the production string is run into the well and stabbed into the bottom hole assembly 26. The well is then capable of producing the reservoir fluids. Alternatively, the well may be used for injection purposes, as desired.

Figure 6:
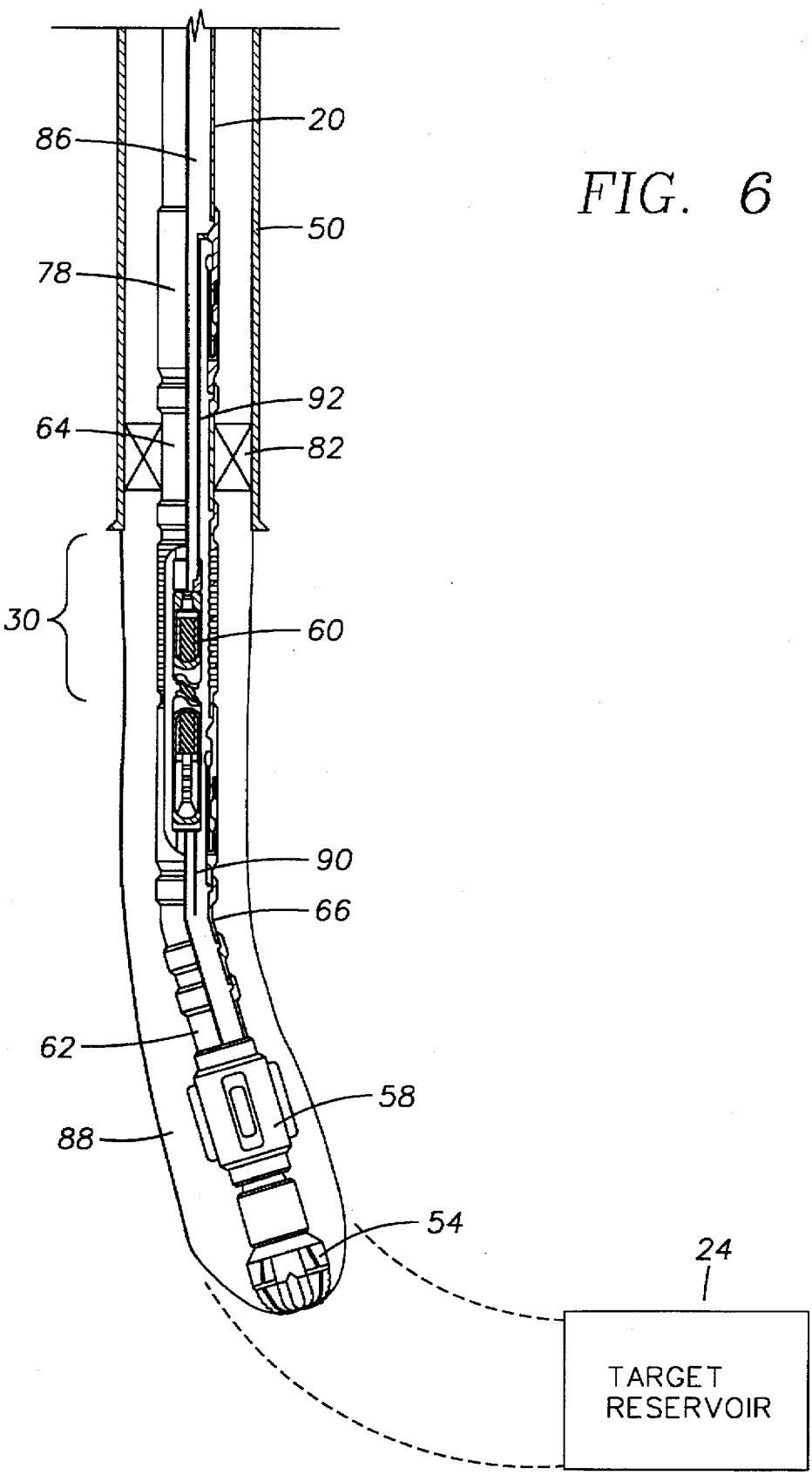
FIG. 6 is a section view of a fourth embodiment of a bottom hole assembly for use in the present invention.

Referring now to FIG. 6, another embodiment of the present invention is disclosed. In this embodimem, a small diameter rotor/stator assembly 60 is positioned within the completion assembly 30. A sealing string 92 is attached to the rotor/stator assembly 60 and then sealed into the connector sub 78. The drive shaft 90 extends from the rotor/stator assembly 60 to the flex joint contained within the adjustable kick off sub 66. Small diameter motors such as the one depicted are commercially available from BHI under the product name Navi-Drill™.

The remainder of the bottom hole assembly 26 is comparable to the embodiment of FIG. 5, and the hang and release packer 82 is used. A lower sensor module 62 is included below the AKO 66, to generate output signals that will be received by the host module for ultimate transmission to the surface by the host module's telemetry system.

In operation of the embodiment of FIG. 6, the operator circulates drilling fluid down the internal bore 86 of the work string 20 and through the rotor/stator assembly 60. Rotation is imparted to the bit 54 via the flex joint and the drive shaft 90. The sealing string 92 assures that the drilling fluid does not exit the bottom hole assembly 26 through the completion assembly 30. A seal must be provided at the lower end of the rotor/stator assembly 60, to prevent drilling fluid backflow up around the rotor/stator assembly 60.

As drilling proceeds, the lower sensor module 62 generates output signals which are received by the host module for ultimate telemetry to the surface, all as previously described. The output signals from the sensors contained within the host module are also transmitted to the surface. After analysis of the data, the operator may steer the bottom hole assembly 26 into proper placement relative to the target reservoir 24.

If an acid soluble compound was included on the completion assembly 30, an acid may be pumped down, in order to dissolve it. Gravel packing the well may also take place at this point, or alternatively, after the production string is in place. Then, the operator can retrieve the work string 20 along with the rotor/stator assembly 60, the flex joints, the drive shaft 90, and the sealing string 92. Thereafter, the production string is run into the well and stabbed into the bottom hole assembly 26. The well is then capable of producing the reservoir fluids. Alternatively, the well may be used for injection purposes.

Figure 7A:
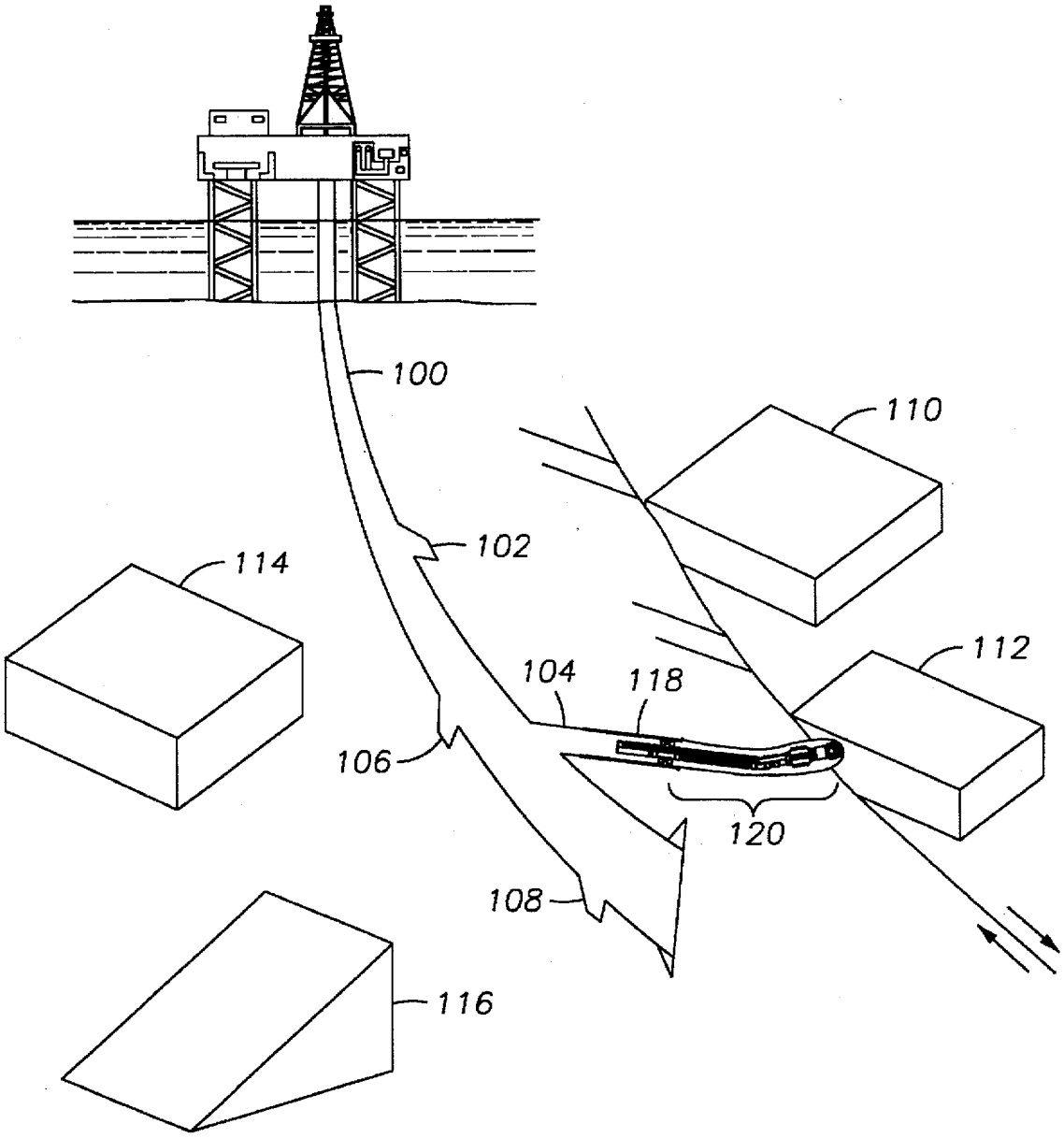
FIG. 7A is a schematic representation of use of the present invention in a branch well bore that extends from a main access well.
Figure 7B:
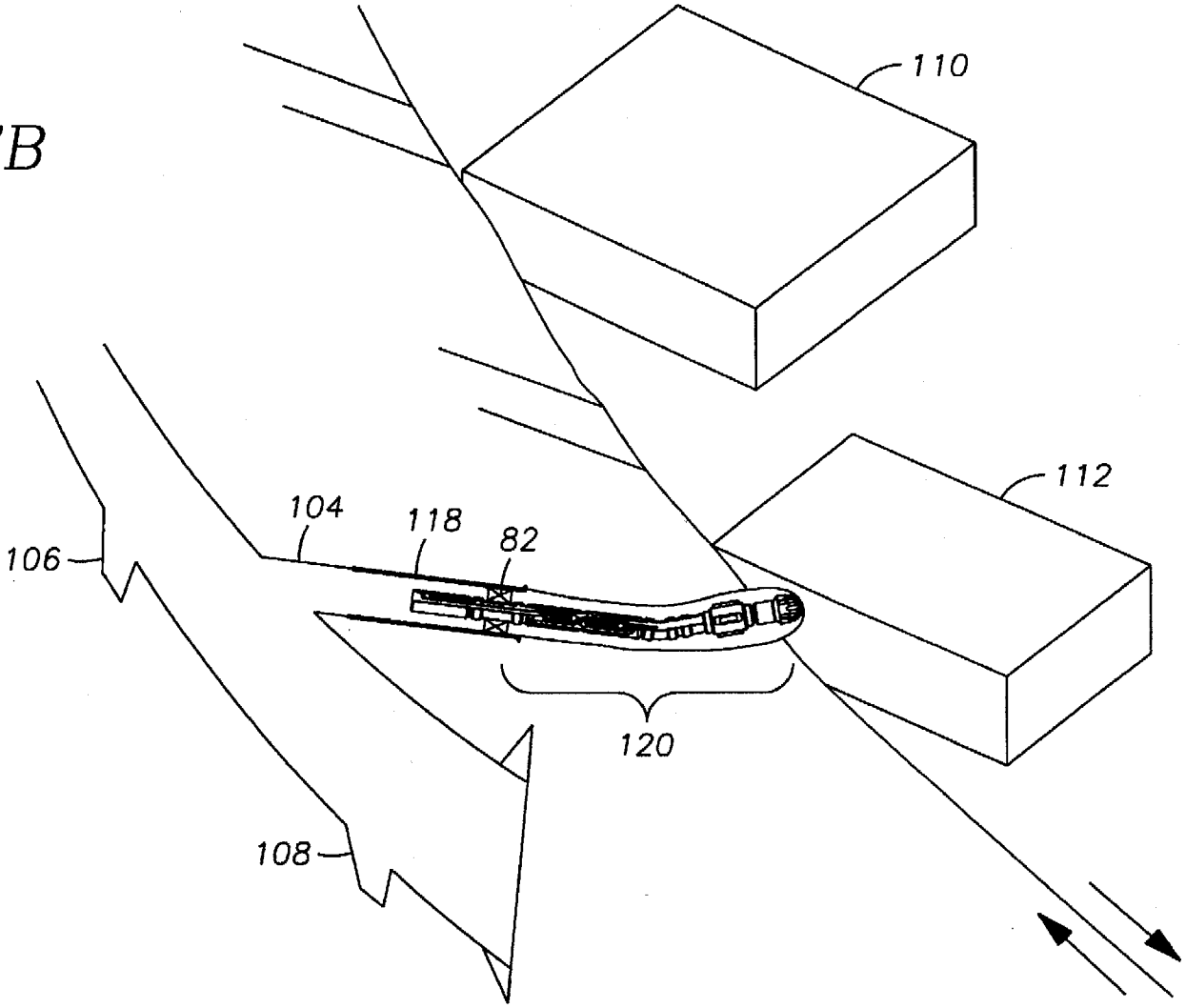
FIG. 7B is an enlargement of a portion of FIG. 7A.

FIGS. 7A and 7B depict use of the present invention with a main access well bore 100. As seen in FIG. 7A, the main access well bore 100 has therein a plurality of windows 102, 104, 106, 108 that will allow for the drilling of branch wells. The windows 102, 104, 106 and 108 are placed so that the branch wells are optimally placed for completion relative to a plurality of reservoirs 110, 112, 114, 116.

As shown in FIG. 7B, a branch well bore 118 has been drilled to the reservoir 112 with a bottom hole drilling assembly 120 similar to the bottom hole assembly 26 shown in FIG. 6. The hang and release packer 82 has been set, the connector sub 78 has been released, and the drill string has been pulled out of the well, leaving the bottom hole assembly 120 in place. In order to drill further, the operator lowers a second work string, such as drill pipe, production tubing, coiled tubing, or snubbing pipe, and stabs into the bottom hole assembly 120. The drilling fluid is then pumped down through the work string and motor to rotate the bit 54. As described earlier, the entire bottom hole assembly 120 is then steered to the desired position relative to the reservoir 112.

Figure 8A:
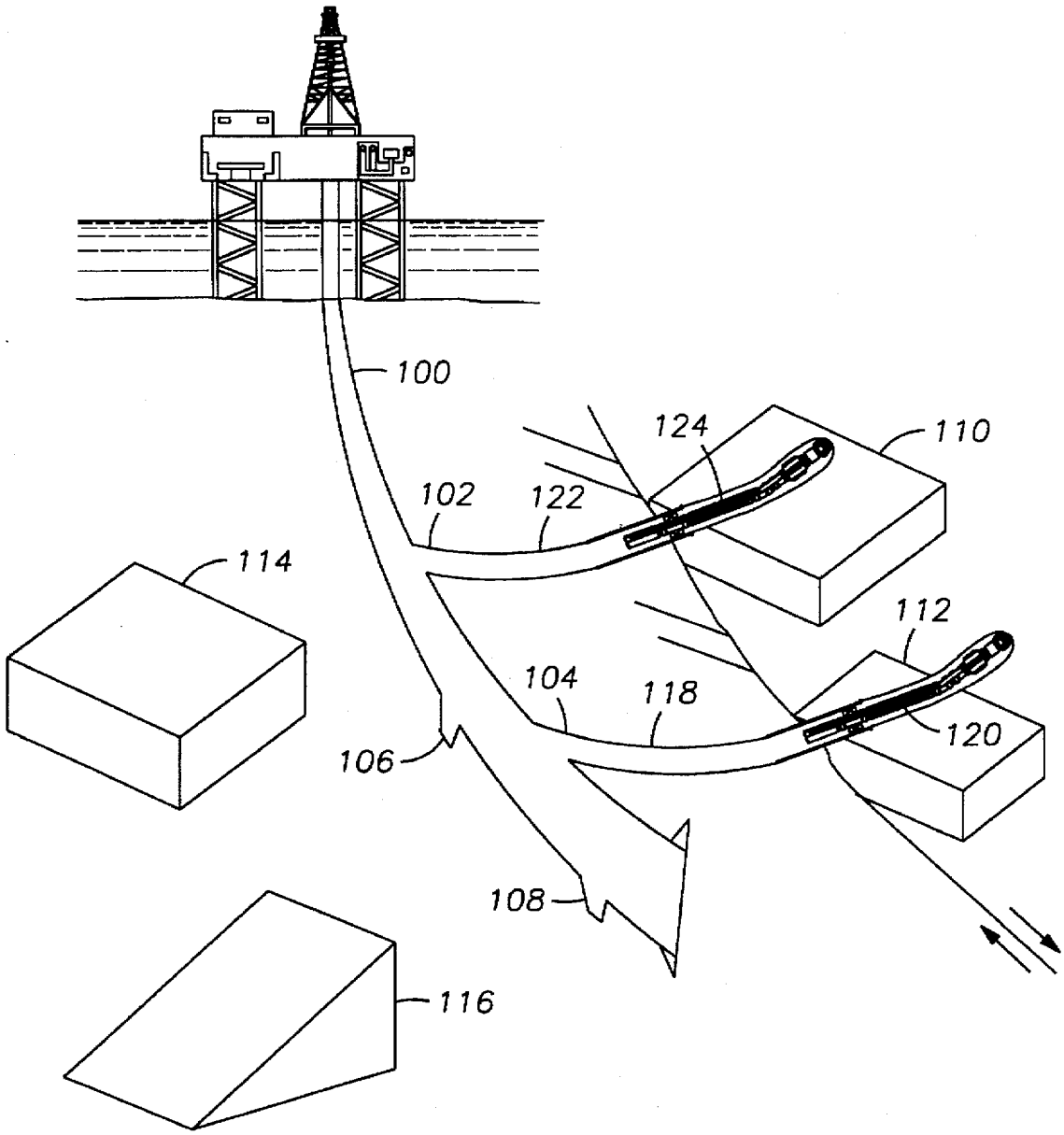
FIG. 8A is a schematic representation of use of the present invention in a first and a second branch.
Figure 8B:
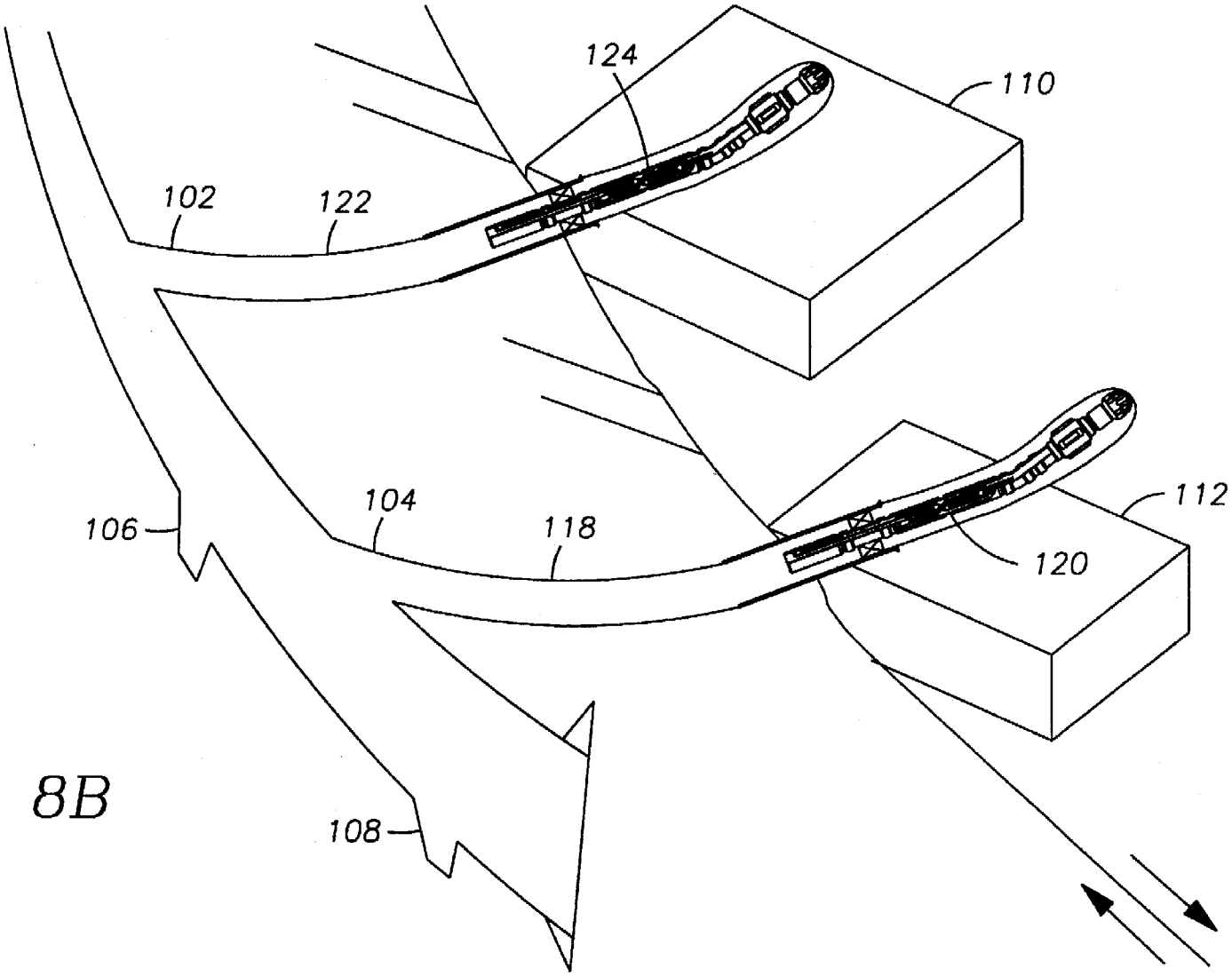
FIG. 8B is an enlargement of a portion of FIG. 8A.

Referring now to FIGS. 8A and 8B, the branch 118 has been drilled through the target reservoir 112, and a second branch well bore 122 has been drilled to the reservoir 110 with the bottom hole assembly 124 which is similar to the bottom hole assembly of FIG. 6. As before, the procedure includes drilling the first branch well bore 118 with the bottom hole assembly 120 so that the completion assembly 30 is adjacent the target site. Then, the work string is disconnected from the bottom hole assembly 120, and retrieved from the main access well 100. The work string is run back into the well 100 with the bottom hole assembly 124 attached thereto. Through the window 102, the well bore 122 is created by drilling with the bottom hole assembly 124 as previously described. The bottom hole assembly 124 is steered into intersection with the reservoir 110, and the work string is then pulled out of the well. Thereafter, production strings may be run into the well 100 and connected to the bottom hole assemblies 120, 124, or other branch wells may be drilled to the other reservoirs 114, 116. The reservoir fluids may be produced via individual production strings or a series of interconnected conduits, while using the production sensor assemblies 84, if desired.

Figure 9:
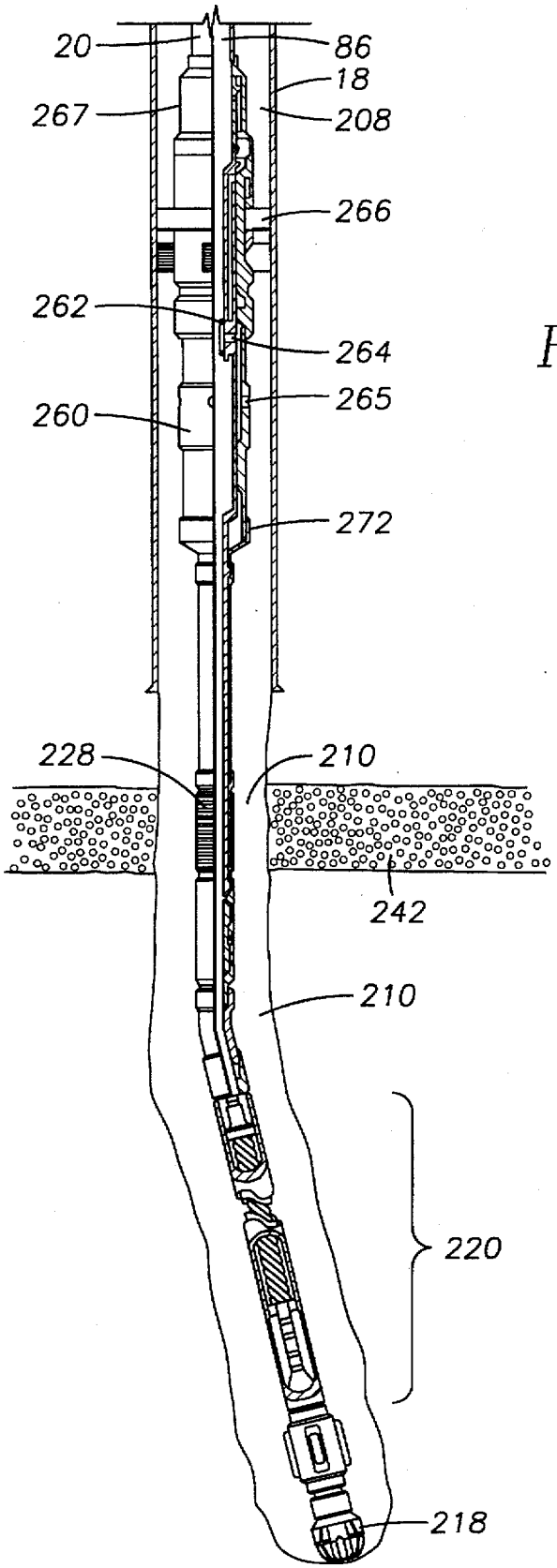
FIG. 9 is a section view of a first embodiment of the present invention used for placing a gravel slurry adjacent the target reservoir.

Referring to FIG. 9, the present invention also provides for the placement of a gravel pack slurry in the annulus 210 adjacent a target reservoir 242. The work string 20 for this embodiment includes the previously described bottom hole assembly 26, with the rotor/stator assembly 220, a bit 218, and a completion assembly 228. In order to place a gravel slurry into the annulus 210, it is also necessary that bottom hole assembly 26 include a gravel pack extension and crossover tool 260 commercially available from Baker Hughes Incorporated under the trade name Model "S-2" Cross-Over™, and the "S-1" Gravel Pack Extension™.

The gravel pack extension and crossover tool 260 contains a sliding sleeve 262 that is slidable from a closed position to an open position. The sliding sleeve 262 is actuated by dropping a ball (not shown) from the surface, with the ball coming to rest on the sliding sleeve 262. By pressuring up on the internal bore 86 of the work string, the operator causes the ball to force the sliding sleeve 262 to an open position.

As seen in FIG. 9, the work string 20 includes a packer 266 that will sealingly engage the intermediate casing 18, so that an upper annulus 208 and a lower annulus 210 are formed. The packer 266 will have operatively connected thereto a setting tool 267, with the associated wash pipe extending therefrom, with the entire assembly being well known in the art and commercially available from Baker Hughes Incorporated under the trade name "SC" Setting Tool™. Alternatively, the "BDP" Setting Tool™ may be used.

One of the functions of the wash pipe is to serve as a conduit for the drilling fluid during the drilling phase. The path of the fluid during drilling is through the inner diameter of the work string 20, through the packer 266, into the wash pipe and through the rotor/stator assembly 220. When the wash pipe is used, it is not necessary to place the acid soluble compound about the completion assembly 228.

The packer 266 is released from the wash pipe and setting tool 267 by rotating the work swing 20 so that the setting tool 267 and wash pipe disengage from the packer 266. Thereafter, the setting tool 267 may be picked up, which in turn lifts the wash pipe which had been previously stung into the top of the rotor/stator assembly 220. The entire wash pipe assembly is lifted up so that the end of the wash pipe is adjacent the completion assembly 228. In this position, the well can be gravel packed. As previously mentioned, the sliding sleeve 262 had been opened, thus, once the wash pipe is in the proper position, the gravel packing process may begin and the sand slurry is pumped down the inner bore 86 of the work string 20. The sand slurry exits into the annulus 210 at ports 264 and 265 into the lower annulus 210. The fluid of the sand slurry will be returned through the porous sand screen on the completion assembly 228 and into the bottom of the wash pipe, and then up through the inner bore of the wash pipe. The fluid is ultimately crossed-over to the upper annulus 208. Once the necessary quantity of sand has been pumped, the work string 20, the setting tool 267, and the wash pipe can be removed from the wellbore. Afterwards, the production string is run into the wellbore, with the production string being stung into the top of the packer 266. Hydrocarbons from the reservoir 242 may then be produced through the completion assembly 228 and up the inner bore of the production string.

Figure 10:
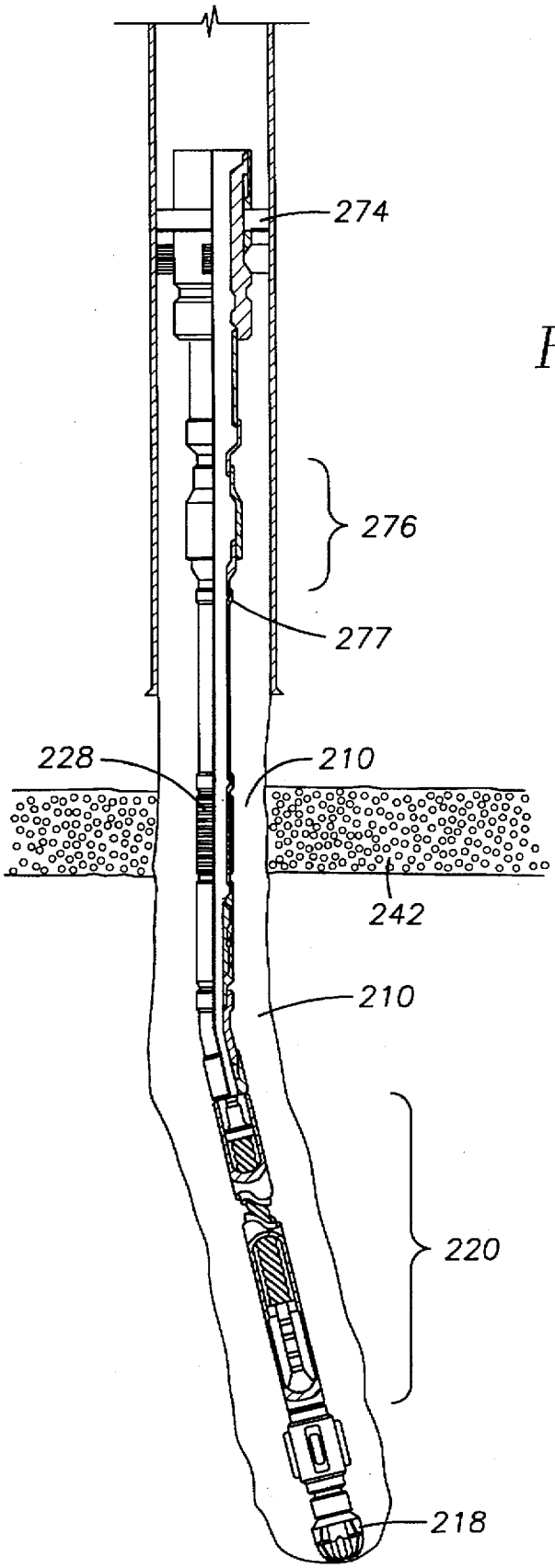
FIG. 10 is a section view of a second embodiment of the present invention used for placing a gravel slurry adjacent the target reservoir.

Referring now to FIG. 10, an alternate embodimem of the present invention is depicted, that can be used when gravel packing is desirable. The bottom hole assembly 26, including the completion assembly 228, the rotor/stator assembly 220, and the bit 218, is essentially the same as those depicted in FIGS. 2 and 3. With the modificatiom to be described, it is possible to gravel pack the lower well annulus 210. Specifically, the embodimemt of FIG. 10 depicts a production type of packer 274 that is connected to the work string. The production packer 274 is commercially available from Baker Hughes Incorporated under the name Retrievable Hydraulic Set Packer. Extending downward from the production packer 274 is the connector 276 for landing the packer 274.

The procedure for drilling, completing and gravel packing the hydrocarbon reservoir 242 with this embodiment begins with drilling through the target reservoir 242 as previously described with the bottom hole assembly depicted in FIGS. 2 and 3. Once the completion assembly 228 is adjacent the target reservoir 242, the lower annulus 210 can be gravel packed by circulating a gravel pack slurry down the upper annulus 208 and getting the fluid returns through the completion assembly 228. The packer 274 is not placed on the original bottom hole assembly 26, because the outer diameter of the packer 274 is too large, and it would prevent the gravel slurry from being effectively pumped down hole, since the slurry would bridge about the packer 274.

After placement of the gravel slurry, the work string is detached from the remainder of the bottom hole assembly 26, utilizing the connector sub 78 that is positioned above the completion assembly 228, as previously described in FIG. 3. Once the connector sub 78 and work string have been pulled from the wellbore, the outer diameter nipple profile 277 remains in the well bore with the rest of the bottom hole assembly 26. Next, a production tubing string is run back into the wellbore, with the production tubing string having the previously mentioned packer 274 and the connector 276 extending therefrom. The connector 276 will be stung into and attach with the outer diameter nipple profile 277. Once the connector 276 is placed within the nipple profile 277, the packer 274 is set against the casing string by hydraulic means such as pressuring up on the annulus. After the packer is set and an upper annulus 208 and lower annulus 210 are formed, the well may then be placed in production.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. An apparatus for both drilling and completing a well from the surface of the earth at a well site to a target subsurface reservoir, said apparatus comprising:

a tubular string extending from a source of pressurized drilling fluid at the surface of the well site, down within a well bore toward the subsurface reservoir, for conducting said drilling fluid from said fluid source to a lower end of said string, and for conducting reservoir fluid from the reservoir to the surface;

a drill bit carried by said string adjacent said lower end thereof for drilling the well bore;

a completion assembly carried by said string above said bit; and at least one aperture in said completion assembly, said at least one aperture being capable of selective opening or closing to give said completion assembly two alternative modes of operation, with a first said mode comprising a drilling mode in which said at least one aperture is selectively closed so that said drilling fluid flows through said completion assembly to said drill bit without passing through said aperture to the well bore, and with a second said mode comprising a completion mode in which said at least one aperture is selectively opened to enable reservoir fluid to flow through said at least one aperture into said completion assembly and up said tubular string to the surface.

2. The apparatus of claim 1, further comprising a production sensor on said string adjacent to said completion assembly for determining properties of the reservoir during production of reservoir fluid from the reservoir.

3. The apparatus of claim 1, wherein said completion assembly is remotely actuatable to move through its modes of operation.

4. The apparatus of claim 1, further comprising a moveable closure member in said completion assembly for closing said aperture, said closure member being movable by actuation remote from said completion assembly for opening or closing said aperture.

5. The apparatus of claim 1, further comprising a removable closure member in said completion assembly for closing said aperture, said closure member being removable from said aperture by actuation remote from said completion assembly for opening said aperture.

6. The apparatus of claim 1, further comprising a connector sub connectable on said string above said completion assembly, said connector sub being selectively operable between a first mode of operation in which an upper portion of said string above said connector sub is connected to a lower portion of said string below said connector sub, and a second mode of operation in which said upper portion of said string is released from said lower portion of said string, thereby allowing removal of said upper portion of said string from the well bore while retaining said lower portion of said string in the well bore.

7. The apparatus of claim 6, wherein said connector sub is selectively operable in a third mode of operation in which a second tubular string lowered into the well bore can be connected to said lower portion of said first tubular string in the well bore.

8. The apparatus of claim 7, further comprising:

a bottom hole drilling assembly connectable to said first tubular string; and a drill motor in said drilling assembly, said drill motor being operable by said drilling fluid, said drill motor being releasably connected to said bit for rotating said bit, and said drill motor being connected to said upper portion of said first tubular string for enabling the retrieval of said drill motor from the well bore when said upper portion of said first tubular string is removed from the well bore.

9. The apparatus of claim 8, further comprising:

an orientation sensor on said first tubular string adjacent to said bottom hole drilling assembly and said completion assembly, for determining positional properties of said string; and a telemetry unit for receiving signals from said orientation sensor and transmitting data to the surface of the well site;

wherein at least said telemetry unit is connected to said upper portion of said first string, allowing retrieval of said telemetry unit from the well bore when said upper portion of said first string is removed from the well bore.

10. The apparatus of claim 8, further comprising:

a formation evaluation sensor on said first tubular string adjacent to said bottom hole drilling assembly and said completion assembly, for determining properties of the subsurface reservoir; and a telemetry unit for receiving signals from said formation evaluation sensor and transmitting data to the surface of the well site;

wherein at least said telemetry unit is connected to said upper portion of said first string, allowing retrieval of said telemetry unit from the well bore when said upper portion of said first string is removed from the well bore.

11. The apparatus of claim 6, further comprising a production sensor on said string adjacent to said completion assembly for determining properties of the reservoir during production of reservoir fluid from the reservoir, said production sensor being connected to said lower portion of said string, allowing retention of said production sensor in the well bore when said upper portion of said string is removed from the well bore.

12. The apparatus of claim 6, wherein said connector sub is selectively operable in a desired said mode of operation in response to actuation remote from said connector sub.

13. The apparatus of claim 6, further comprising a selectively settable anchor on said lower portion of said string, said anchor being operable between a first mode of operation in which said anchor is spaced from the wall of the well bore, thereby allowing movement of said string through the well bore and a second mode of operation in which said anchor engages the wall of the well bore for securing said lower portion of said string in place in the well bore.

14. The apparatus of claim 6, further comprising a selectively settable seal member on said lower portion of said string, said seal member being operable between a first mode of operation in which said seal member is spaced from the wall of the well bore, thereby allowing fluid flow between the annulus above said seal member and the annulus below said seal member, and a second mode of operation in which said seal member engages the wall of the well bore, thereby blocking fluid flow between the annulus at said upper portion of said string and the annulus at said lower portion of said string in the well bore.

15. The apparatus of claim 14, further comprising a movable plug member in said lower portion of said string for selectively closing said string to fluid flow into and out of said lower portion of said string.

16. A method of drilling and completing a well in a target subsurface reservoir, comprising:

providing a tubular string connected to a source of pressurized drilling fluid, a drill bit attached to a lower end of said string for drilling a well bore, and a completion assembly on said string above said bit, said completion assembly being selectively operable in two modes of operation, a first said mode constituting a drilling mode in which said completion assembly contains the flow of said drilling fluid in said string, thereby directing said drilling fluid to said bit, while blocking the flow of said drilling fluid to the well bore around said completion assembly, and a second said mode of operation constituting a completion mode in which said completion assembly has an exterior opening enabling the flow of reservoir fluids from a subsurface reservoir into said completion assembly and thence into said tubular string;

putting said completion assembly in said first mode of operation;

directing said drilling fluid under pressure into said tubular string;

rotating said drill bit and lowering said tubular string into the earth to form a well bore;

drilling and positioning the well bore so that said completion assembly is positioned relative to a target subsurface reservoir; and putting said completion assembly in said second mode of operation to allow reservoir fluids to enter said completion assembly and said tubular string.

17. The method of claim 16, further comprising:

providing a connector sub on said tubular string above said completion assembly, said connector sub being selectively operable between a first mode of operation in which an upper portion of said string above said connector sub is connected to a lower portion of said string below said connector sub, and a second mode of operation in which said upper portion of said string is released from said lower portion of said string;

detaching said upper portion of said string from said lower portion of said string;

removing said upper portion of said string from the well bore, thereby leaving said lower portion of said string in the well bore;

lowering a second tubular string into the well bore; and connecting said second string to said lower portion of said first tubular string in the well bore.

18. The method of claim 17, wherein said drilling and positioning of the well bore further comprises:

drilling a main access well bore;

drilling a first lateral well bore from said main access well bore;

positioning said first string in said first lateral well bore;

removing said upper portion of said first string while retaining said lower portion of said first string in said first lateral well bore;

drilling a second lateral well bore from said main access well bore, using a second well bore string comprising an upper portion and a second lower portion; and removing said upper portion of said second string while retaining said lower portion of said second string in said second lateral well bore.

19. The method of claim 17, further comprising:

providing a drill motor in said tubular string, said drill motor being connected to said upper portion of said string; and retrieving said drill motor when said upper portion of said string is removed from the well bore.

20. The method of claim 17, further comprising:

providing a sensor on said lower portion of said string;

providing a telemetry unit on said upper portion of said string;

putting said telemetry unit in communication with said sensor and in communication with the surface of the well site; and retrieving said telemetry unit with said upper portion of said string.

21. The method of claim 17, further comprising:

providing a production sensor on said lower portion of said string; and retaining said production sensor with said lower portion of said string in the well bore, upon retrieval of said upper portion of said string.

22. The method of claim 17, further comprising:

providing a selectively settable anchor on said lower portion of said string; and setting said anchor against the wall of the well bore to secure said lower portion of said string in the well bore.

23. The method of claim 16, further comprising:

providing a selectively settable seal member on said lower portion of said string; and setting said seal member against the wall of the well bore to seal against fluid flow between said upper portion and said lower portion of said string in the well bore.

24. The method of claim 16, wherein putting said completion assembly in said second mode of operation to allow reservoir fluids to enter said completion assembly further comprises:

providing a closure member in said lower portion of said string; and positioning said closure member to close said lower portion of said string to prevent fluid communication in and out of said lower portion of said string.

25. The method of claim 16, further comprising:

pumping gravel slurry downhole to pack the lower portion of the well bore; and returning slurry fluid to the surface through said completion assembly.

* * * * *

US005667023B1

REEXAMINATION CERTIFICATE (4046th)

United States Patent [19] [11] B1 5,667,023

Harrell et al. [45] Certificate Issued Apr. 18, 2000

[54] METHOD AND APPARATUS FOR DRILLING AND COMPLETING WELLS

[75] Inventors: John W. Harrell; Michael H. Johnson; Daniel J. Turick; Larry A. Watkins, all of Houston, Tex.

[73] Assignee: Baker Hughes Incorporated, Houston, Tex.

Reexamination Request:
No. 90/005,360, May 17, 1999

Reexamination Certificate for:

| | |
|---|---|
| Patent No.: | **5,667,023** |
| Issued: | **Sep. 16, 1997** |
| Appl. No.: | **08/666,150** |
| Filed: | **Jun. 19, 1996** |

Related U.S. Application Data

[63] Continuation of application No. 08/528,574, Sep. 15, 1995, abandoned, which is a continuation-in-part of application No. 08/343,814, Nov. 22, 1994, Pat. No. 5,842,528.

[51] Int. Cl.[7] ..... E21B 7/04; E21B 43/04

[52] U.S. Cl. ..... 175/45; 166/358; 166/296; 166/366; 166/278; 175/61; 175/41; 175/107

[58] Field of Search ..... 175/45, 41, 61, 175/19, 74, 75, 53, 107, 65; 166/258, 278, 296, 366

[56] References Cited

U.S. PATENT DOCUMENTS 5,320,178 6/1994 Cornette ..... 175/19

*Primary Examiner*—Dennis L. Taylor

[57] ABSTRACT

A method and apparatus for drilling and completing a bore hole are disclosed. The method comprises positioning a work string in the well, with a bottom hole assembly attached. The bottom hole assembly can include a drill bit, a drilling motor, orientation instrumentation, and a completion assembly. A fluid is circulated to drive the drill bit to drill the well to a target formation. Then, the completion assembly is used to produce fluids from the formation. Gravel packing can also be performed with the bottom hole assembly.

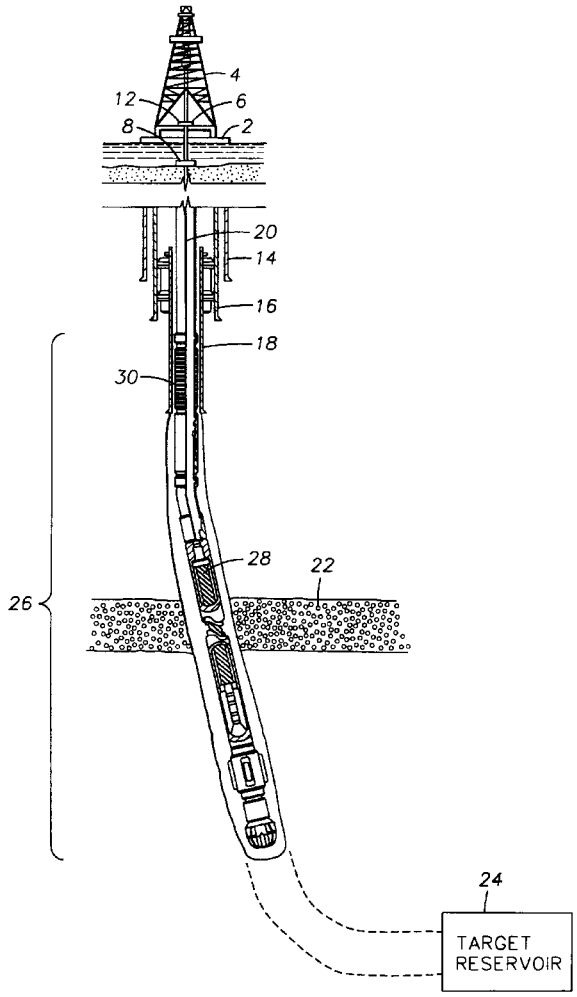

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–25 is confirmed.

* * * * *